United States Patent [19]

Taddei

[11] Patent Number: 4,819,376

[45] Date of Patent: Apr. 11, 1989

[54] DRIVING AND GUIDING APPARATUS FOR A HORIZONTALLY PIVOTED WING

[75] Inventor: Silvio Taddei, Pergine, Italy

[73] Assignee: Silvelox S.p.A., Pergine, Italy

[21] Appl. No.: 110,168

[22] Filed: Oct. 19, 1987

[30] Foreign Application Priority Data

Oct. 24, 1986 [IT] Italy ..... 84954 A/86

[51] Int. Cl.[4] ..... E05F 15/00

[52] U.S. Cl. ..... 49/200; 49/204; 49/280

[58] Field of Search ..... 49/200, 199, 280, 203, 49/204

[56] References Cited

U.S. PATENT DOCUMENTS

| | | | |
|---|---|---|---|
| 3,224,493 | 12/1965 | Houk | 49/280 X |
| 3,704,548 | 12/1972 | Wiegleb | 49/199 |
| 3,839,827 | 10/1974 | Dickinson | 49/200 X |
| 4,442,631 | 4/1984 | Weber | 49/199 |
| 4,472,910 | 9/1984 | Iha | 49/200 X |

*Primary Examiner*—Philip C. Kannan

*Attorney, Agent, or Firm*—Guido Modiano; Albert Josif

[57] ABSTRACT

A driving and guiding apparatus for a counter-weighed horizontally pivoted wing, particularly for a garage door. The apparatus comprises a structure embedded in an opening that the wing is designed to close, two lateral vertical guides for the wing formed in the embedded structure, an articulation rod on each side and two lateral weight-carrying cables turning around a respective pulley. The apparatus also comprises a drive means for opening and closing the wing which includes a motor-driven transmission shaft which extends along the lintel of the opening in which the wing is mounted, a pinion mounted on each end of the transmission shaft and a toothed wheel mounted coaxially and rigid in rotation with each pulley. Each toothed wheel meshes with a respective pinion so that the rotation of the transmission shaft in one direction causes controlled unwinding of the cables, and thus the opening or lifting of the wing, and its rotation in the opposite direction causes its shutting or lowering.

7 Claims, 2 Drawing Sheets

FIG. 1
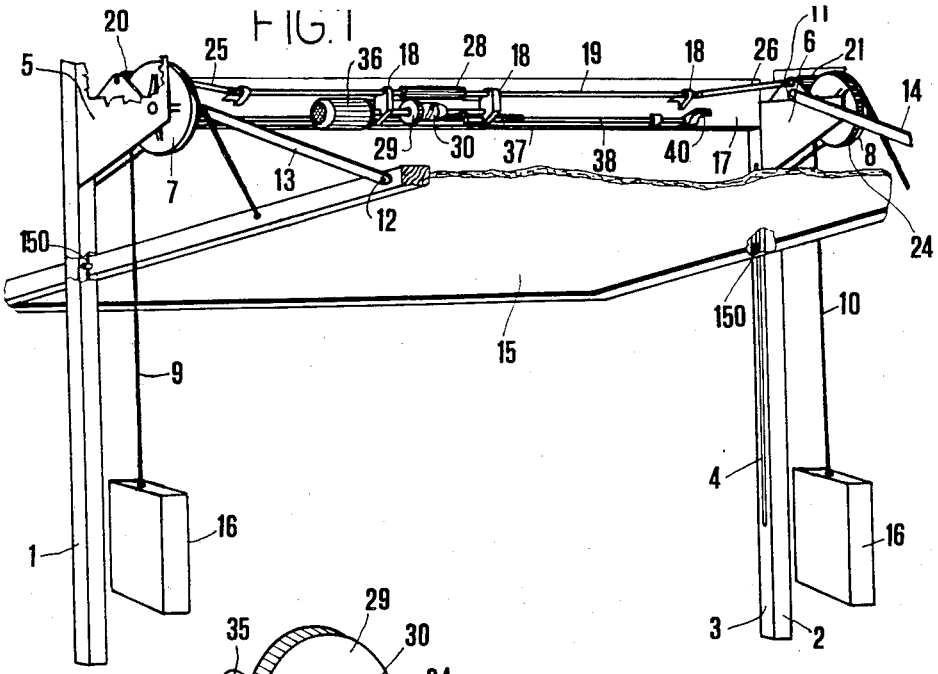
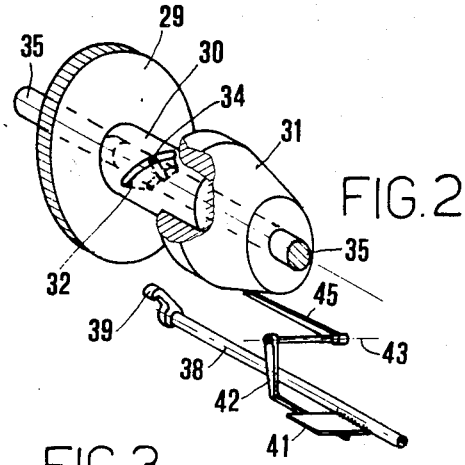
FIG. 2
FIG. 3
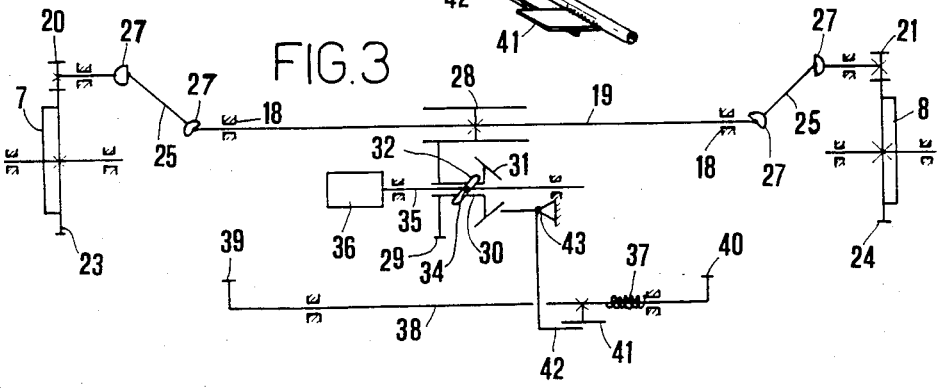

DRIVING AND GUIDING APPARATUS FOR A HORIZONTALLY PIVOTED WING

BACKGROUND OF THE INVENTION

The present invention relates to a driving and guiding apparatus for a horizontally pivoted wing. Horizontally pivoted doors are already known, e.g. for garages, which are laterally guided along vertical lateral guides and are counterweighed by means of lateral cables turning around a respective pully and loaded with a weight or by a spring. The lifting and lowering (opening and shutting) of such doors occurs by means of articulated rods having one end linked to one side of the wing and the other end pivoted to a fixed bracket projecting from the lintel of the opening in which the horizontally pivoted door is mounted, such a bracket also bearing a pully around which one of the cables turns. Thus, such a horizontally pivoted door is restrained at both sides downwards by the lateral guides, upwards by the articulated rods and in intermediate positions by the counterweighed cables.

It has already been suggested (see for example the Italian patent application No. 47528 A/77 in the name of H. J. VOGT) to provide a motor-driven drum at the centre of the lintel for the winding-unwinding of a band or belt having its free end secured to the internal surface of the door to assist said door during its closing phase. Between the winding drum and the motor a joint or coupling friction is provided which allows the belt or band to be freely or idly unwound and wound by the motor for automatically shutting the wing.

Such a solution, however, is not satisfactory as it does not allow the wing being assisted and thus controlled during the opening phase. Furthermore, particularly when the wing has a considerable width, mere pulling the wing into its closed position by means of a band acting at an intermediate position of the wing does not guarantee full lifting of the wing. This can, for example, prevent a vehicle from passing under the wing, especially if the vehicle can enter the garage only if the wing is fully opened.

SUMMARY OF THE INVENTION

The main object of the present invention is to provide a driving and guiding apparatus for a counterweighed horizontally pivoted wing which is arranged to assist and thus to keep under permanent control the wing during both opening (lifting) and closing (lowering) phases.

Another object of the present invention is that the said driving and guiding apparatus can leave the horizontally pivoted wing disengaged once lifted or lowered.

Another object of the present invention is to provide a driving and guiding apparatus arranged to keep the wing locked in its closed position and to automatically unlock it before being opened.

A further object of the present invention is that the said driving guiding apparatus be reliable in operation, have small overall dimensions, competitive manufactoring costs and be easily and quickly accessible, assembled and disassembled for repairing and maintanance purposes and can be applied to already installed horizontally pivoted wings.

These and still other objects, which will better appear further ahead, are attained by a driving and guiding apparatus for a horizontally pivoted counterweighed wing which comprises a structure to be embedded in an opening the wing is designed to close, two lateral vertical guides for the wing formed in the structure to be embedded, an articulation rod on each side of the wing, two lateral cables turning around a respective pully and bearing a respective counterweight, a drive means for opening and closing the wing, and reversible motor means for the drive means arranged to obtain synchronized rotation of each pulley and synchronized movement of each counterweight, whereby the rotation of said pulleys or the movement of said counterweights in one direction causes controlled unwinding of said cables, and thus the opening or lifting of the wing, and their rotation or movement in the opposite direction causes its closing or lowering.

Advantageously the driving and guiding apparatus comprises a motor-driver transmission shaft which is mounted for rotation and extends along the lintel of the said opening and is rigid in rotation with each pulley, and a spring-loaded latch lever mechanism designed to engage and lock the wing when the latter is brought into its closed position and to release the wing before being opened.

BRIEF DESCRIPTION OF THE DRAWINGS

Further aspects and advantages of the present invention will appear from the following detailed description of preferred, but not exclusive, embodiments thereof with reference to the accompanying drawings, in which:

FIG. 1 is a diagrammatic view of an embodiment of an apparatus according to the present invention with a partly open wing;

FIG. 2 shows a detail on enlarged scale of FIG. 1;

FIG. 3 shows a diagrammatic view illustrating the functional components of a driving device for the opening and closing of the wing;

DESCRIPTION OF THE PREFERRED EMBODIMENTS

Figure 4:
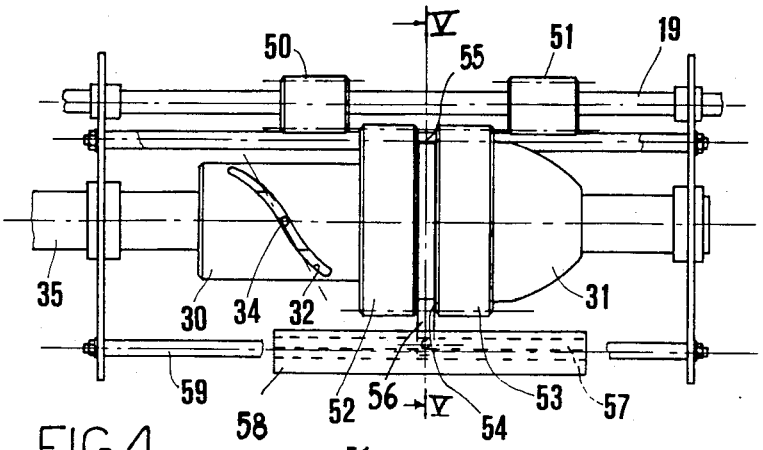
FIG. 4 is a diagrammatic elevational view of another embodiment of the driving and guiding apparatus according to the invention.

In the drawings same or similar components and parts have been indicated with the same reference numerals. The driving and guiding apparatus shown in FIGS. 1 to 3, comprises an embedded carrying structure which includes two vertical side frames 1 and 2 which have a respective vertical guide 4 (only one of which is visible in FIG. 1) along their opposite or inner faces 3. At the top each side frame carrys an overhanging bracket 5, 6, on which a pulley 7, 8, for a cable 9, 10 is mounted for rotation. One end of a rod 13 is also articulated at 11 to each bracket and its other end is pivoted at 12 to a side of the wing 15. The wing is constrained along its edges at its higher part by the rods 13, 14 on its lower part to the guides 4, e.g. by means of a sliding pin 150 which engages a respective guide 4, and is anchored at an intermediate position to one end of cables 9, 10 carrying a respective weight 16.

At the top thereof the side frames 1 and 2 can be connected by a connecting cross member 17 which also acts as a covering member for the lintel of the opening the wing 15 is designed to close. On the cross member 17, or in its absence directly on the lintel, a trasmission shaft 19 is mounted for rotation on suitable supports 18 and has two terminal toothed pinions 20 and 21. Pinions 20 and 21 in turn engage with a respective toothed wheel 23, 24 mounted co-axial and rigid in rotation with a respective pulley 7, 8. Since the axis of the pinions 20 and 21 is parallel but located at a higher level than that of shaft 19, between pinions 20 and 21 and the transmission shaft an intermediate section 25, 26 is provided which has articulated joint ends 27.

Centrally, shaft 19 bears a relatively long gear 28 rigid in rotation with it. A toothed wheel 29 is in meshing and sliding engagement with the gear 28 and is rigid with one end of a co-axial bush or sleeve 30 which has its other end 31 of fusto-conical and preferably enlarged shape. Sleeve 30 is formed with an inclined-plane slot 32, in which a pin 34 rigid with a shaft 35 can slide. The shaft 35 is rotatably mounted in a sleeve or bush 30 and constitutes the output shaft of a reversable polarity motor 36.

Below the shaft 19 a parallel control shaft 38 is mounted for rotation in contrast with a return spring 37 and bears two overhanging latches 39 and 40 at each end thereof to snap engage during the closing phase a respective notch or ring (not shown) provided at the top of the wing 15. At an intermediate position the shaft 38 has an overhanging lug 41 which engages with one arm of a bell-crank lever 42 fulcrumed around an axis 43 and whose other arm 45 abuts against the truncated-cone surface 31.

The above described driving and guiding apparatus operates as follows. Assuming to start from the lifted or open position of the wing 15, current is supplied upon control by the user to the motor 36 which will rotate in the direction that causes the weights 16 to be raised. During the first ¼ to ½ rotation of its output shaft 35, the pin 34 is moved to the opposite end of slot 32 to abut against it and thus causing the group formed by the sleeve or bush 30 and toothed wheel 29 to be displaced towards the motor 36, thereby freeing the arm 45 and thus the arm 38. The latter owing to the thrust of the spring 37 can then rotate so as to bring the latches or spikes 39 into a lowered position ready to snap engage the respective notches or rings on the wing once this has been closed. During such a displacement the toothed wheel 29 slides along gear wheel 28 without causing it to rotate. As soon as pin 34 reaches the other end of the slot 32, the connection between shaft 35 and sleeve 30 becomes rigid, and thus shaft 35 sets in rotation the wheel 29 which in turn causes gear wheel 28, shaft 19, pinions 20 and 21, gear wheels 23, 24, and thus their respective pulleys 7, 8, to rotate. Cables 9 and 10 are friction engaged and thus driven by pulleys 7, 8 act, therefore, both as a support for the counterweights 16 which counterbalance the weight of the wing and as returning or control elements for wing 15 thus, by controlling the rotation of the pulleys 7 and 8 the pull of the counterweights 16 is governed, and thus when the pulleys 7 and 8 rotate in one direction the counterweights 16 are lowered and the wing is urged to move to its opened position, whereas when they rotate in the opposite direction the counterweights 16 are gradually lifted to allow the wing to move, mostly due to gravity, to its closed position, as is well known in the art. While the wing 15 is being lowered (closed) or raised (opened), the rods 13 and 14 act as guiding and stabilizing members and are arranged to take a substantially vertical position (where their pins 12 are located at a lower level than their respective pins 11) when the wing 15 is closed and a substantially horizontal position when the wing is fully opened.

Once returned and accompanied in its fully closed position, wing 15 is snap engaged by hooks 39, 40 and held locked by them in position, whilst the motor 36 stops, e.g. due to the action of one or more limit-switches (not shown) or other equivalent control means.

For the opening the reverse procedure occurs. On command which can cause automatic polarity reversion of the motor 36, the latter is set in rotation in the opposite direction. Throughout the first ¼ to ½ rotation, the output shaft 35 moves surface 31 so as it abuts against the arm 45, thereby lifting hooks 39, 40 and consequently unlocking the wing. Then the shaft 19 is set in rotation in the direction in which the counterweights 16 are lowered and wing 15 is lifted (opened) at the same time.

It will be noted that the wing 15 is constantly guided and controlled by the apparatus during all its movements. Moreover, the wing is pulled in a balanced manner at its sides by cables 9, 10 so as not to be subjected to warping stress.

Furthermore, when owing to rain, snow or wind the wing 15 experiences variations in weight, which is a frequent phenomenon with wooden horizontally pivoted wings, there is no risk, as sometimes happens with conventional solutions, that the wing does not shut properly again, because the motor 36 operates until the hooks 39, 40 have engaged the wing in its fully closed position.

The wing 15 can be manually disengaged from the hooks 39, 40 through a suitable lever system which can be controlled by a handle, not shown, and can be manually opened (lifted) by overcoming the weak resistance provided by the motor 36.

Figure 5:
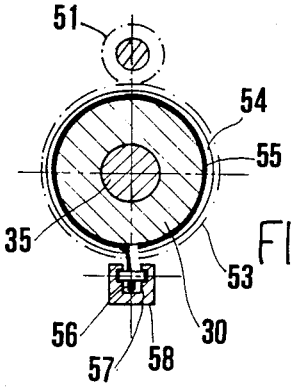
FIG. 5 shows a cross-section taken along the line V-V of FIG. 4.

To avoid having to operate in contrast with the resistance of the motor 36, it is possible to advantageously adopt the solution illustrated in the embodiment shown in FIGS. 4 and 5, where two gear wheels 50 and 51 spaced from each other are keyed to the shaft 19, and the toothed wheel 29 rigid with the bush or sleeve 30 is divided into two twin portions 52 and 53 by an intermediate groove 54. The distance between the gears 50 and 51 is slightly greater than the width of the two portions 52 and 53 and the groove 54, whereby these can be arranged in an idle or non-meshing position between the gears 50 and 51. The groove 54 locates a resilient strap 55 which is wound around it and has an end 56 extending to slidingly engage a longitudinal recess 57 formed in a fixed engaging bar 58 carried by a longitudinal member 59.

Alternatively, the resilient strap 55 has a fork-like shape and can be arranged astride of the longitudinal member 59 and around the groove 54 so as to slidably engage with it, in which case no bar 58 is provided.

The resilient strap 55 has the function of acting as a friction to ensure a soft mesh engagement between gear wheels 51 and 53 and the gears 50 and 51. With this arrangement when current is supplied to the motor 36, the output shaft 35 rotates in one direction, e.g. in clockwise direction, for the opening of the wing. In other terms, owing to the engagement between slot 32 and pin 34 the output shaft 35 throughout its first ¼ rotation moves the sleeve 30, e.g. to the right (when viewing FIG. 4), while bringing the toothed portion 53, also owing to the slightly braking effect of the resilient strap 55, to mesh with gear 51 and simultaneously bringing the frustoconical portion to engage the arm 60 (FIG. 6) to look the wing.

Once the lifting is completed a limit switch (not shown) sends a signal to a control circuit (not shown) for the motor, which is arranged to switch over the polarity of the motor and causes it to rotate through a $\frac{1}{4}$ rotation in the opposite direction (anticlockwise) thereby bringing the sleeve 30, and thus the toothed portions 52, 53, to the idle position illustrated in FIG. 4. For shutting the cycle is repeated in reverse order, i.e. upon supplying current to the motor, the toothed portion 52 is brought to mesh with the gear 50, then the wing is lowered, after which the toothed portions 52, 53 are brought to the idle position of FIG. 4.

In this position, the gears 50 and 51 are not meshing with the output shaft of the motor, and thus the wing can be manually moved, while the motor offers no resistance. This circumstance makes it possible to easily open and shut manually the wing, e.g. in case of failure in the electric power supply network.

The above described invention is liable to numerous modifications and variations within the scope defined by the appended claims.

Thus, for example, the transmission shaft 19 can be coaxial with the axis of rotation of the pulleys 7 and 8 and its ends directly fixed to the pulleys, thereby directly rotating them without the need of providing articulated joints or pinion-tooth-wheel couplings. Moreover, according to another embodiment the engagement between pinion 20, 21 and pulley 7, 8 can occur directly without a specific toothed wheel 23, 24 being provided.

It should also be understood that the locking and unlocking mechanism comprising the latches 39, 40 the shaft 38 and the lever arms 42 can have other configurations with a simplified structure and a reduced number of components.

Figure 6:
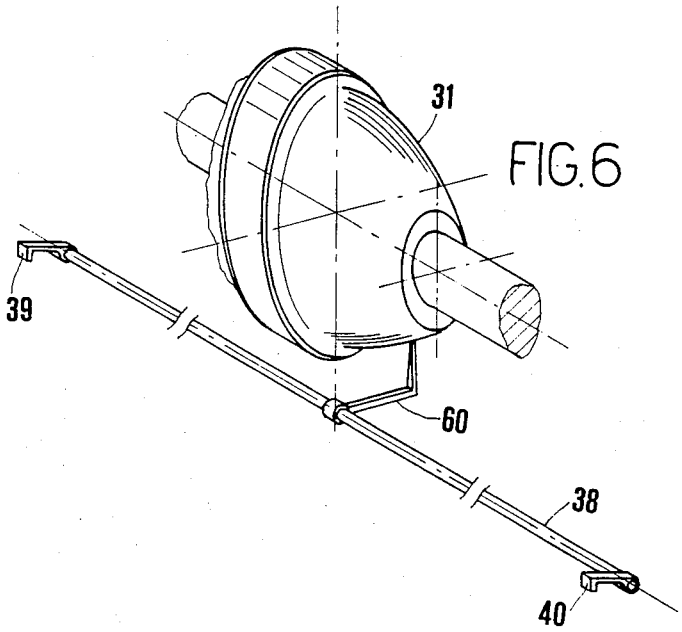
FIG. 6 shows a prospective view on enlarged scale of a detail of FIG. 4.

Advantageously, as shown in FIG. 6, the control shaft 38 can be operated by the frustaconical end 31 of the bush by means of an overhanging arm 60 slidingly engaging the surface 31.

The engagement-desengagement group including the toothed wheel 29, the bush 30 and the surface 31 can have the engaging surface arranged otherwise or the function of the inclined-plane surface can be accomplished by other equivalent means such as an engagment-desengagement mechanism for two-position arm 45, in which case the return spring 37 can be omitted.

Moreover, the opening and shutting device for the wing can also comprise two electric motors each mounted in a to-and-from operation relationship with a respective pulley, or with counterweights 16 e.g. by means of a pinion and rack transmission, and synchromization means, e.g. electronic synchronization means, arranged to synchronize the rotational movements of the two motors.

Materials and dimensions can be various according to requirements.

I claim:

1. A driving and guiding apparatus for a horizontally pivoted counterweighed wing arranged to close an opening provided with lintel portion, which apparatus comprises a wingcarrying frame structure to be embedded in, or secured to, the opening the wing is designed to close, and having two side vertical guides therein, an articulation rod on each side of the wing having one end linked to the said frame structure and its other end pivoted to a respective side of the wing, a pin projecting from each side of the wing and slidably engaging a respective side vertical guide in the frame structure, two lateral pulleys mounted for rotation on said frame structure, each having a respective cable turning around it, one end of the cable being secured to a respective side of said wing at a intermediate position between the pivoted end of the respective articulation rod and the projecting pin thereof, and its other end carrying a respective counterweight, and a drive means equipped with reversible motor means for synchronized rotation of said pulleys in either direction, the rotation of said pulleys in one direction resulting in controlled unwinding of said cables and thus the lowering of the counterweights and the opening or lifting of the wing and their rotation in the opposite direction resulting in raising of the counterweights and closing or lowering, of the wing.

2. An apparatus as claimed in claim 1, wherein the said drive means comprises a drive shaft operatively connected to the said motor means, a bush or sleeve slidably mounted on said drive shaft and formed with an inclined-plane slot, a pin rigid with the drive shaft and in sliding engagement with said inclined-plane slot, at least one toothed wheel rigid in rotation with the said bush or sleeve, a transmission shaft mounted for rotation along the lintel of said opening and bearing at least one gear rigid in rotation therewith and designed to mesh with the or a respective toothed wheel, the said transmission shaft being in driving relationship with each pulley, whereby for each change in the direction of rotation of said drive shaft the said bush or sleeve moves in either direction along the drive shaft, and a locking-unlocking mechanism for the wing when in its closed position, said mechanism being operatively connected and arranged to be actuated by the said bush or sleeve.

3. An apparatus as claimed in claim 2, wherein said locking-unlocking mechanism comprises locking and unlocking ratched gear means having at least one overhanging spike or hook mounted for rotation on the lintel, and a transmission linkage means arranged between the or each spike or hook and the said bush or sleeve, whereby said bush or sleeve, when moving in one direction along the drive shaft engages the transmission linkage means, and thus the ratchet gear means is locked, and desengages it when moving in the opposite direction.

4. An apparatus as claimed in claim 3, wherein the said linkage means comprises a control shaft bearing the or each spike or hook and rigid in rotation therewith, and the said bush or sleeve has an inclined-plane surface arranged in sliding engagement with the said transmission linkage means.

5. An apparatus as claimed in claim 2, wherein the said drive means comprises two gears rigid in rotation with the transmission shaft and spaced from one another a length greater than the width of the or each toothed wheel, whereby the or each toothed wheel can be moved therebetween by the said bush or sleeve in non-meshing engagement with any of the two gears.

6. An apparatus as claimed in claim 2, wherein each pulley is rigid in rotation with a respective co-axial toothed wheel and said drive means comprises a transmission pinion for each pulley, each transmission pinion being in meshing engagement with a respective toothed wheel and rigid in rotation with said transmission shaft.

7. An apparatus as claimed in claim 6, wherein the said transmission shaft comprises at least one intermediate articulated section.

* * * * *